US006238206B1

(12) United States Patent
Cummings, III et al.

(10) Patent No.: US 6,238,206 B1
(45) Date of Patent: May 29, 2001

(54) LOW-EMISSIONS INDUSTRIAL BURNER

(75) Inventors: William G. Cummings, III, Indianapolis; Curtis L. Taylor, Muncie, both of IN (US)

(73) Assignee: Maxon Corporation, Muncie, IN (US)

( * ) Notice: Subject to any disclaimer, the term of this patent is extended or adjusted under 35 U.S.C. 154(b) by 0 days.

(21) Appl. No.: 09/423,740

(22) PCT Filed: May 13, 1998

(86) PCT No.: PCT/US98/09525

§ 371 Date: May 16, 2000

§ 102(e) Date: May 16, 2000

(87) PCT Pub. No.: WO98/51966

PCT Pub. Date: Nov. 19, 1998

Related U.S. Application Data

(60) Provisional application No. 60/046,358, filed on Mar. 13, 1998, and provisional application No. 60/077,926, filed on May 13, 1997.

(51) Int. Cl.[7] ..... F23D 14/02

(52) U.S. Cl. ..... 431/181; 431/159; 431/187; 431/5; 431/8; 431/10

(58) Field of Search ..... 431/5, 10, 8, 9, 431/158, 181, 182, 183, 187, 188, 265, 284, 350, 353, 354, 159; 239/419, 419.5; 60/737, 749

(56) References Cited

U.S. PATENT DOCUMENTS

| | | |
|---|---|---|
| 1,669,810 | 5/1928 | Clapham . |
| 2,771,744 | 11/1956 | Johnson et al. . |
| 4,457,696 | 7/1984 | Schwartz et al. . |
| 5,087,194 | 2/1992 | Viessmann . |
| 5,380,194 | 1/1995 | Polomchak et al. . |

FOREIGN PATENT DOCUMENTS

| | | |
|---|---|---|
| 3702415 C1 | 4/1988 | (DE) . |

*Primary Examiner*—Carl D. Price
(74) *Attorney, Agent, or Firm*—Barnes & Thornburg

(57) ABSTRACT

A burner (10) for use in both high $O_2$ environments and low $O_2$ environments comprises an outer tube (24) and an inner tube (26). The outer tube (24) defines a flow passage (53) and includes an inlet portion (42), an outlet portion (46), and a nozzle portion (44) interconnecting the inlet portion (42) and outlet portion (46). The inlet portion (42) has a larger effective cross-sectional area than the outlet portion (46) so that air (20) or an air-and-fuel mixture (35) moving through nozzle portion (44) is accelerated. The inner tube (26) is positioned to lie in the flow passage (53) of the outer tube (24) and is formed to include fuel-injection holes (78) to conduct fuel (33) into the flow passage (53).

42 Claims, 11 Drawing Sheets

LOW-EMISSIONS INDUSTRIAL BURNER

CROSS-REFERENCES TO RELATED APPLICATIONS

This application is a U.S. national application of international application Ser. No. PCT/US98/09525 filed May 13, 1998, which claims priority to U.S. provisional applications Ser. Nos. 60/046,358 and 60/077,926 filed May 13, 1997, and Mar. 13, 1998, respectively.

BACKGROUND AND SUMMARY OF THE INVENTION

The present invention relates to burner assemblies, and particularly, to a low-emissions industrial burner. More particularly, the present invention relates to a low-emissions industrial burner for burning a combustible mixture to produce a flame.

One challenge facing the burner industry is to design a burner with minimal parts that produces low nitrogen oxide ($NO_x$) emissions during operation. Typically, a mixture of gaseous fuel and either air or oxygen in the proper ratio is created in an industrial burner to produce a combustible fuel-and-air mixture. The mixture is then ignited and burned to produce a flame that can be used to heat various products in a wide variety of industrial applications. However, when the fuel and air are not mixed completely or are not mixed in the proper ratio, combustion of fuel such as natural gas, oil, liquid propane gas, low BTU gases, and pulverized coals often produce high levels of several unwanted pollutant emissions such as nitrogen oxide ($NO_x$), carbon monoxide (CO), and total hydrocarbons (THC).

According to the present invention, a burner is provided having an outer tube defining a flow passage and an inner tube being positioned to lie in the flow passage. The outer tube includes an inlet portion having a large diameter, an outlet portion having a small diameter that is smaller than the large diameter of the inlet portion, and a nozzle portion interconnecting the inlet and outlet portions. The inlet portion of the outer tube is adapted to be coupled to an air supply to conduct air through the flow passage. The inner tube includes an inlet end that is adapted to be coupled to a fuel supply and is formed to include at least one fuel-injection hole to conduct fuel from the fuel supply into the flow passage to establish a combustible air-and-fuel mixture within the flow passage.

In one preferred embodiment, the burner is coupled to a long refractory block. The long refractory block extends beyond the outlet end of the burner and creates a flame chamber within the refractory block for containing the flame. The fuel-injection holes formed in the inner tube are preferably positioned in the outlet portion of the outer tube. However, the fuel-injection holes can also be positioned in the nozzle portion or inlet portion of the outer tube and/or an air-and-fuel mixture can be supplied at the inlet end of the burner.

In a second embodiment, a burner is coupled to a short refractory block. The short refractory block terminates prior to the outlet end of the burner so that the outlet end of the burner extends beyond the refractory block. This allows an air-and-fuel mixture discharged from an exit end of the burner to mix with recirculated furnace gas contained in a furnace chamber in which the flame burns because the flame is not contained within a flame chamber defined by the refractory block.

Additional features of the present invention will become apparent to those of ordinary skill of the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

A burner in accordance with the present invention is well-suited for use in high-oxygen processes or environments such as thermal oxidizers, fame incinerators, and pollutant-burning afterburners wherein the concentration of oxygen ($O_2$) in the process chamber is greater than twelve percent (typically seventeen to nineteen percent oxygen). The present burner is also well-suited for use in low-oxygen processes or environments such as boilers, furnaces, kilns, and rotary dryers wherein the concentration of oxygen in the process chamber is less than or equal to twelve percent (typically less than six percent). Burner 10 can also be used, for example, to incinerate industrial fumes, to heat water, or to generate steam.

Figure 1:
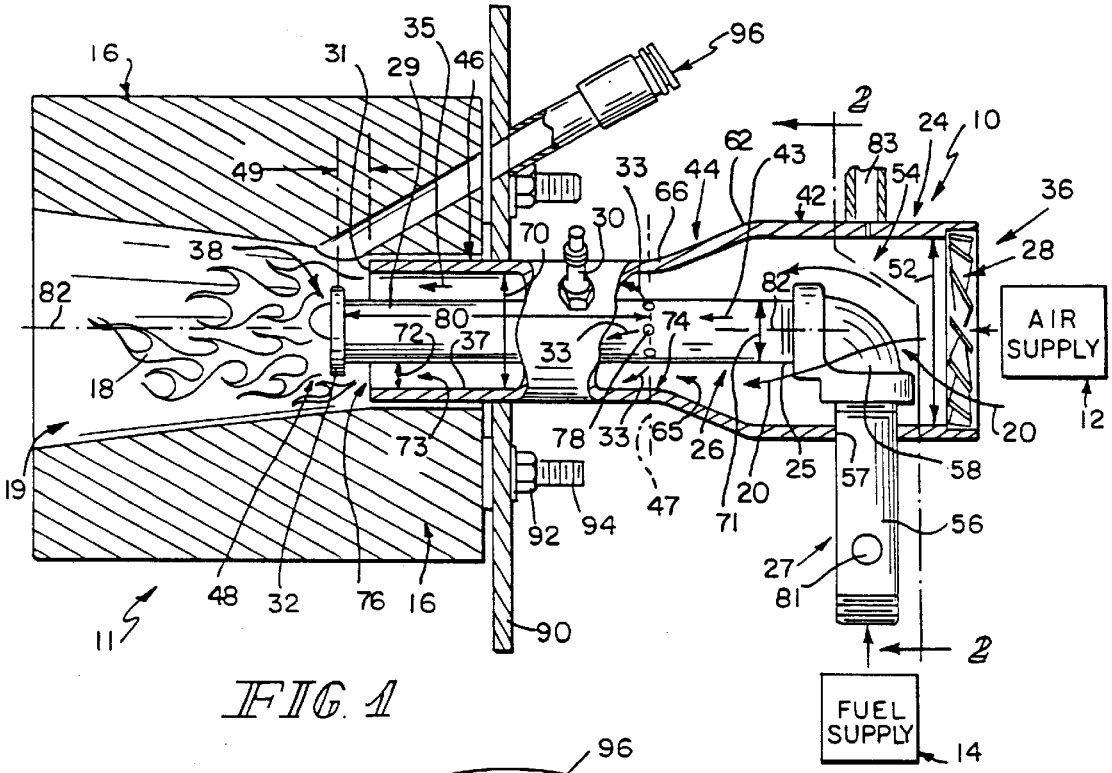
FIG. 1 is a side elevation view of a burner assembly including a burner in accordance with a first embodiment of the present invention, with portions broken away, showing a fuel supply and air supply coupled to an inlet end of the burner and a long refractory block coupled to an outlet end of the burner and formed to include a chamber for containing a flame produced by the burner, the burner including an outer tube carrying a swirl plate and conducting air discharged from the air supply and swirled by the swirl plate through a nozzle section to the flame chamber, an inner tube coupled to the fuel supply and configured to discharge fuel into an accelerated air stream in the outer tube so as to create a combustible air-and-fuel mixture therein, a bluff-body flame holder coupled to a downstream end of the inner tube, and an ignitor coupled to the outer tube to ignite the combustible air-and-fuel mixture therein.
Figure 2:
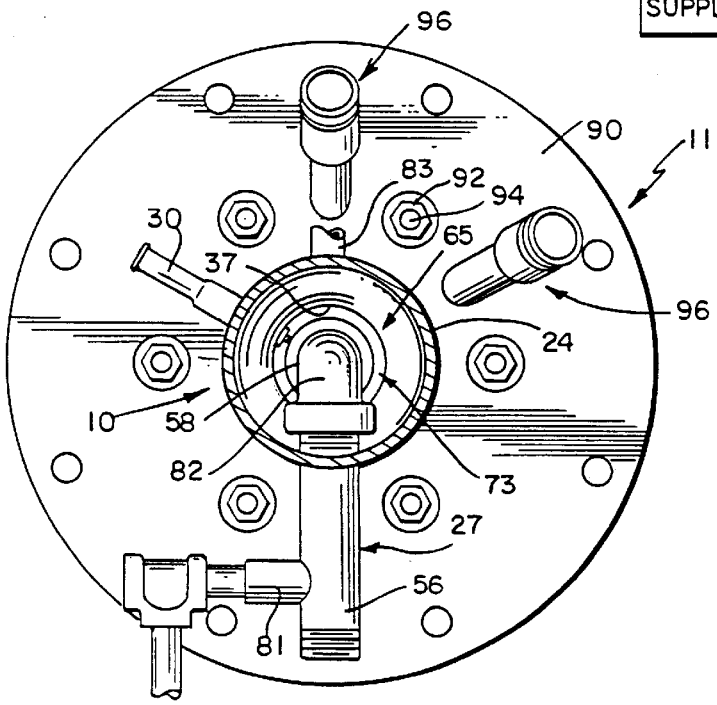
FIG. 2 is a view of the burner assembly taken along lines 2—2 of FIG. 1 through the outer tube at a location downstream of the swirl plate showing the inner fuel tube extending through the outer air tube.

A burner assembly 11 including a burner 10 in accordance with the present invention is illustrated in FIG. 1. Burner 10 operates in conjunction with an air supply 12, a fuel supply 14, and a refractory block 16 to produce a low-emissions flame 18 within a flame chamber 19 formed in refractory block 16. Burner 10 includes an outer tube 24, an inner tube 26, a swirler 28, an ignitor 30, and a bluff-body flame holder 32. As used herein, "tube" means any conduit or channel, regardless of shape (i.e., cylindrical cross-section, rectangular cross-section or otherwise), through which something (such as a liquid, solid, or gas) is conveyed or conducted. Swirler 28 is positioned to lie at an air inlet end 36 of burner 10 and flame holder 32 is positioned to lie at a flame outlet end 38 of burner 10. Inner and outer tubes 26, 24 and flame holder 32 are preferably made of heat resistant alloys. For example, inner and outer tubes 26, 24 are preferably made of 18-8 stainless steel, and bluff-body flame holder 32 is made of 310 stainless steel.

In use, air 20 is introduced on a centerline 82 of burner 10 into a rear portion of burner 10 and directed to pass over swirler 28, which provides stability when excess air is present, and mix with gaseous fuel 33, which is injected perpendicularly to the stream of air 20. A combustible air-and-fuel premixture 35 is thus established, which flows through a smooth flow passageway 73 and passes over bluff-body flame holder 32, where premixture 35 burns within refractory block 16 (or, for example, a metallic sleeve) to produce flame 18.

Burner assembly 11 uses refractory block 16 as a combustion chamber in conjunction with an air-and-fuel premixing apparatus which operates to premix air 20 and fuel 33 partially prior to ignition while the air 20 is forced through burner 10 by a fan (not shown) coupled to air supply 12. Ignitor 30 is positioned to communicate with air-and-fuel premixture 35 at a point in burner 10 upstream of the zone of flame attachment. In burner 10, the possibility of early flame attachment is minimized because: (1) air-and-fuel mixture 35 is moved at a velocity that exceeds the flame speed and (2) the flow passageway 75 is relatively smooth to minimize possible turbulence. Although the burner of the present invention includes both of these features, either feature alone (as well as other features) could be used to accomplish the same result. For example, even if a burner does not have a "smooth" flow passage, the mixture could be moved at a high enough velocity to avoid early flame attachment. Similarly, an extremely smooth flow passage could be used even with lower mixture velocities while avoiding early flame attachment. Thus, although both features are present in the present preferred embodiment, it is within the scope of the present invention to minimize the possibility of early flame attachment using either feature independently or other similar features.

As shown in FIG. 1, in the preferred embodiment burner 10 has four sections: an air-admitting section (or inlet portion) 42, an air-accelerating section (or nozzle portion) 44, a mixing/igniting section (or outlet portion) 46, and a flame-holding section 48. Outer tube 24 is shaped and configured to define sections 42, 44, and 46. Bluff-body flame holder 32 is positioned to lie adjacent to one end of outer tube 24 to define section 48.

Air-admitting section 42 of burner 10 is defined by a cylindrical portion of outer tube 24 located at air inlet end 36 of burner 10 as shown, for example, in FIG. 1. This inlet portion 42 of outer tube 24 has a relatively larger inner diameter 52 and defines a low-velocity passageway 54 that conducts swirling air 20 discharged from air supply 12 and passed through swirler 28 in a downstream direction 43 toward air-accelerating section (or nozzle portion) 44. Air 20 passing through large-diameter passageway 54 in air-admitting section 42 travels in downstream direction 43 at a relatively low velocity, thereby minimizing the air pressure drop across swirler 28. Preferably, air 20 travels at a velocity approximately equal to 50 feet/sec (1524 cm/sec) within air-admitting section 42 which results in a pressure drop of about 0.5 inches of water (column) (12.70 Kg./sq. meter) across swirler 28. An air pressure tap 83 is coupled to outer tube 24 and configured to sense pressure of air 20 in passageway 54. By locating swirler 28 in a low-velocity environment away from ignitor 30 and refractory block 16, swirler 28 is less likely to be damaged by heat or high-velocity pressures and therefore is likely to last longer.

Air-accelerating section 44 of burner 10 is defined by a conical portion of outer tube 24 located between air inlet end 36 and flame outlet end 38 of burner 10 as shown, for example, in FIG. 1. Conical (or nozzle) portion 44 has an inner diameter 52 at its inlet end 62, a relatively smaller inner diameter 70 at its outlet end 66, and a nozzle-shaped passageway 65 that converges in downstream direction 43. Nozzle-shaped passageway 65 functions like a nozzle to accelerate the flow rate of air 20 flowing from air-admitting section 42 through air-accelerating section 44 toward flame outlet end 38 of burner 10. When swirler 28 is mounted in chamber 54 of air-admitting admitting section 42, then air 20 passing through nozzle-shaped passageway 65 is swirling while it is accelerating.

Mixing/igniting section (or outlet portion) 46 of burner 10 is defined by a cylindrical portion of outer tube 24 located at flame outlet end 38 of burner 10 as shown, for example, in FIG. 1. Cylindrical outlet portion 46 of outer tube 24 has a smaller inner diameter 70 and conducts accelerated, swirling air 20 discharged from air-accelerating section 44 at high velocity further along in downstream direction 43 toward flame chamber 19 in refractory body 16. Inner tube 26 is configured to discharge fuel 33 into the accelerated, swirling air 20 passing through cylindrical portion 46 of outer tube 24 so that a combustible air-and-fuel mixture 35 moves at high velocity past ignitor 30 toward flame chamber 19.

Inner tube 26 is positioned to lie in outer tube 24 as shown, for example, in FIG. 1 and is formed to include constant outer diameter 71. An upstream end 25 of inner tube 26 is coupled to fuel supply 14 by a fuel supply line 27 and a downstream end 29 of inner tube 26 is configured to support bluff-body flame holder 32 in flame chamber 19 of refractory block 16 in spaced-apart relation to a downstream end 31 of the cylindrical portion 46 of outer tube 24. Fuel supply line 27 includes an elbow-shaped pipe 58 coupled to upstream end 25 of inner tube 26 and a supply pipe 56 coupled to elbow-shaped pipe 58 and to fuel supply 14. Supply pipe 56 passes through an opening 57 formed in a side wall of outer tube 24 as shown, for example, in FIGS. 1–4. A pilot inlet tube 81 is appended to supply pipe 56 as shown, for example, in FIGS. 1–14.

Figure 4:
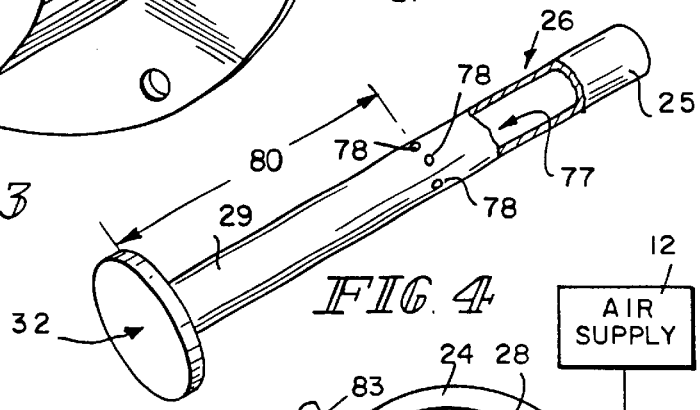
FIG. 4 is a perspective view of the inner tube of FIG. 1 showing the bluff-body flame holder coupled to the downstream end of the inner tube and fuel-injection holes formed in a portion of the inner tube located upstream from the bluff-body flame holder.

Inner tube 26 is configured to conduct fuel 33 received from fuel supply line 27 through a passageway 77 formed therein as shown, for example, in FIG. 4 and then discharge fuel 33 into outer tube 24 so that it mixes with swirling air 20 conducted through cylindrical portion 46 of outer tube 24 to form a combustible air-and-fuel mixture 35 traveling in downstream direction 43 through a high-velocity passageway 73 defined by inner and outer tubes 26, 24 toward bluff-body flame holder 32 and flame chamber 19 in refractory body 16. In a preferred embodiment, high-velocity passageway 73 is annular and surrounds a cylindrical exterior surface 39 of inner tube 26 and is bounded by a cylindrical interior surface 37 of outer tube 26 that is positioned to surround inner tube 26.

Air 20 has accelerated to a maximum velocity at exit end 66 of air-accelerating section 44 and then enters inlet end 74 of high-velocity passageway 73 provided in mixing/igniting section 46. Air 20 continues to flow and swirl through the mixing/igniting section 44 at a constant velocity because inner diameter 70 of high-velocity passageway 73 remains constant along the length of mixing/igniting section 46. The distance between inner tube 26 and outer tube 24 within the mixing/igniting section 46 is shown as constant radial gap 72 that defines annular high-velocity passageway 73 in mixing/igniting section 46. The axial airspeed through the mixing/igniting section 44 should be slow enough to allow thorough mixing of the fuel and air, but fast enough to prevent early flame attachment (i.e., flame attachment upstream from the flame holder). For example, airspeed of 250 feet/second (7620 cm/sec) has been found to be slow enough for complete mixing but fast enough to avoid early flame attachment for burners having a turndown ratio of 15:1.

Fuel-injection holes 78 are formed in inner tube 26 at a point near inlet end 74 of high-velocity passageway 73 in mixing/igniting section 46 in the embodiment of FIGS. 1–5 to communicate with the fuel-conducting passageway 77 formed in inner tube 26 so that fuel 33 discharged from passageway 77 in inner tube 26 is injected perpendicularly into high-velocity, swirling air 20 discharged from nozzle-shaped passageway 65 in air-accelerating section 44 of burner 10. The distance 80 from fuel-injection holes 78 to flame holder 32 is called the "mixing length" and is preferably two times the hydraulic diameter, where the hydraulic diameter equals the inner diameter 70 of high-velocity passageway 73 minus the outer diameter 71 of inner tube 26. Perpendicular fuel injection into a stream of swirling air causes fuel 33 to mix with air 20 in a "complete" manner. By locating fuel-injection holes 78 near inlet end 74 of high-velocity passageway 73 after air 20 has been accelerated to its maximum velocity in burner 10, the chance of having fuel 33 flow upstream in direction 45 back towards air-accelerating section 44 is minimized. Also, by injecting fuel 33 into the accelerated air, the chance of burning within the burner 10 is minimized.

Fuel-injection holes 78 are positioned to lie in circumferentially spaced-apart relation to one another around cylindrical exterior surface 39 of inner tube 26 so that the fuel-injection holes 78 are aligned to lie along a plane 47 that slices perpendicularly through inner tube 26, as shown in FIG. 1. Preferably, fuel is injected at a pressure of four times air pressure and fuel-injection holes 78 are spaced approximately 45° apart so that the proper amount of fuel 33 can be injected into high-velocity swirling air 20 in the proper stoichiometric ratio. The combination of mixing length 80, annular gap 72, and the diameter and spacing of fuel-injection holes 78 allows burner 10 to achieve low $NO_x$ emissions, given the proper air/fuel ratio.

Air-and-fuel mixture 35 travels toward exit end 76 of mixing/igniting section 46. Ignitor 30 ignites mixture 35 so that mixture 35 burns temporarily within high-velocity passageway 73 in mixing/igniting section 46 of burner 10. However, ignitor 30 stays lit for less than 4 seconds so that air-and-fuel mixture 35 will not continue to burn within high-velocity passageway 73 of mixing/igniting section 46. Instead, because of acceleration of flow rate of swirling air 20 in nozzle-shaped passageway 65 of air-accelerating section 44, the flow rate of air-and-fuel mixture 35 is sufficiently high (i.e., greater than 0.25 inches of water (column)) (6.35 Kg./sq. meter) so that the ignited air-and-fuel mixture 35 is "pushed" downstream in direction 43 out of mixing/igniting section 46 of burner 10 by unlit mixture once the ignitor 30 is turned off.

After the ignited fuel-and-air mixture passes through exit end 76 of mixing/igniting section 46, the ignited mixture 35 must pass around bluff-body flame holder 32 mounted on downstream end 29 of inner tube 26. Preferably, bluff-body flame holder 32 is offset slightly by offset distance 49 (i.e., a distance less than the inner tube 26) from exit end 76 of mixing/igniting section 46 so that bluff-body flame holder 32 resides within the flame chamber 19 formed in refractory block 16, as shown in FIG. 1. This not only enhances mixing by allowing more air and fuel to flow out of exit end 76, but it also allows bluff-body flame holder 32 to be serviced easily since a wrench can be applied to a portion of inner tube 26 that extends in direction 43 past downstream end 31 of outer tube 24 without interference from outer tube 24. By positioning bluff-body flame holder 32 away from the air-and-fuel mixing chamber in high-velocity passageway 73, a larger recirculation pattern can be achieved without having to introduce fuel 33 out to flame holder 32 to stabilize flame 18 without a $NO_x$ penalty.

Once the ignited air-and-fuel mixture 35 passes through exit end 76, flame 18 attaches to bluff-body flame holder 32 within flame chamber 19 in refractory block 16 where it continues to burn. Preferably, refractory block 16 is made of alumina/silica, although other refractory block materials could also be used. In addition, burner 10 is capable of being operated without using a refractory block 16 and still achieves low $NO_x$ emissions with low levels of excess air coming through the burner.

As shown in FIGS. 1–5, burner 10 is connected to refractory block 16 by faceplate 90 and nuts and bolts 92, 94. Preferably, a sight glass 96 can also be used to ensure that a proper flame 18 is burning within refractory block 16. Preferably, face plate 90 is continuously welded to outer tube 24 to ensure that no leakage occurs between faceplate 90 and outer tube 24.

Figure 3:
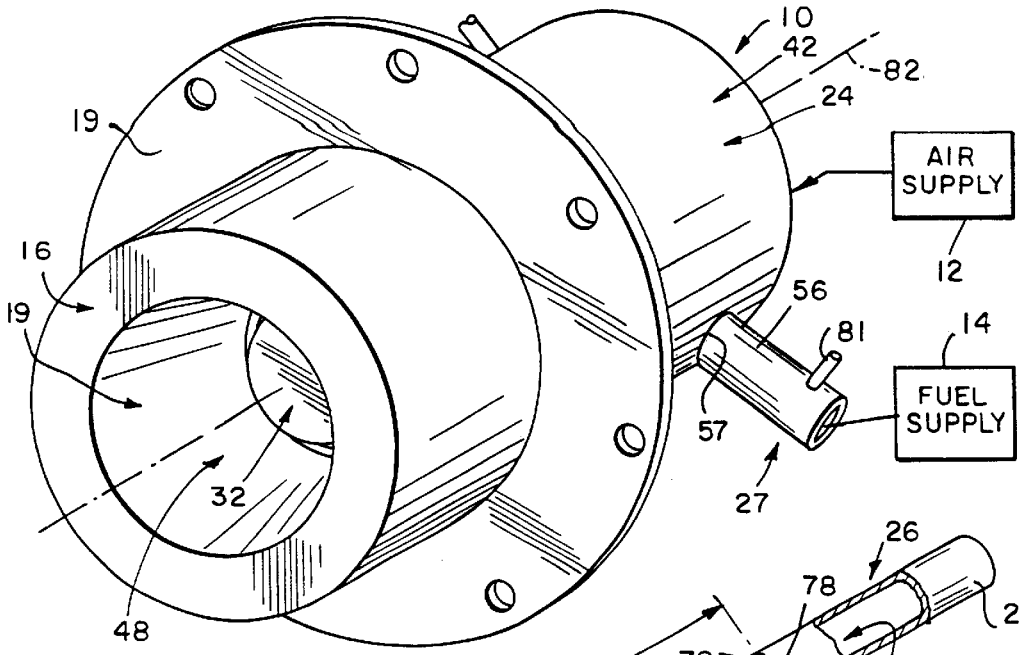
FIG. 3 is a front perspective view of the burner of FIG. 1 showing the bluff-body flame holder positioned in the flame chamber formed in the refractory block.

As shown in FIG. 3, burner 10 and refractory block 16 are generally cylindrical in shape and are connected by generally circular face plate 90. However, as shown in FIG. 5, burner 10 is also slightly funnel-shaped due to the nozzle-shaped configuration of air-accelerating section 44 located between the upstream air-admitting section 42 and the downstream mixing/igniting section 46.

Figure 5:
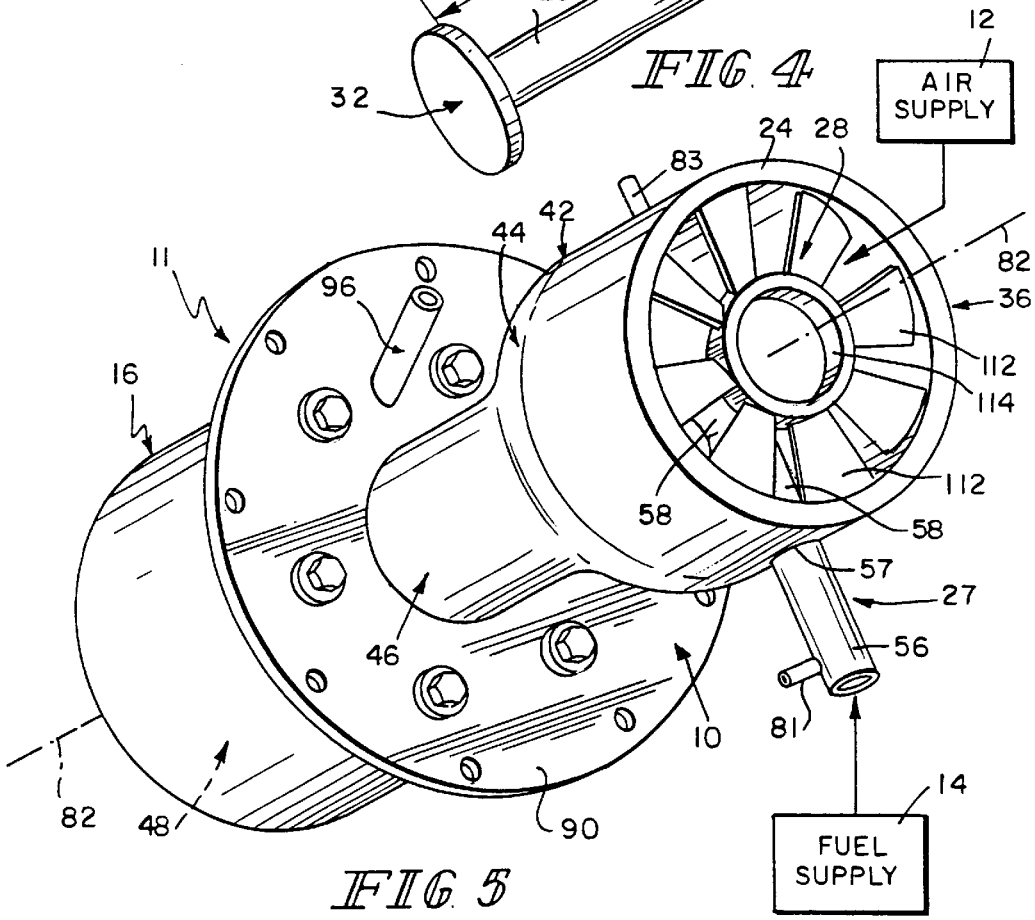
FIG. 5 is a rear perspective view of the burner of FIG. 1 showing the swirl plate coupled to an air inlet section of the burner for swirling the air flow through the burner and showing a fuel supply tube extending perpendicularly through the outer tube in the air inlet section of the burner.

Air inlet end 36 of burner 10 is also shown best in FIG. 5. As shown in FIG. 5, swirler 28 includes fins 112 and a body portion 114 coupled to fins 112. Fins 112 extend radially outwardly from body portion 114 and are twisted in a fan-like manner so that air 20 from air supply 12 enters air-admitting section 42 in a swirling manner as shown in FIG. 1. As mentioned above, by locating swirler 28 in a low-velocity environment away from ignitor 30 and refractory block 16, swirler 28 is less likely to be damaged by heat or high pressures and therefore is likely to last longer.

Inner fuel tube 26 and bluff-body flame holder 32 are shown in more detail in FIG. 4. Inner tube 26 is formed to include fuel-injection holes 78 that are equally spaced around the circumference of inner tube 26. Downstream from fuel-injection holes 78, bluff-body flame holder 32 is attached to inner tube 26. Bluff-body flame holder 32 not only aids with the mixing of air 20 and fuel (not shown), but bluff-body flame holder 32 also closes downstream end 29 of inner tube 26 so that fuel 33 discharged into upstream end 25 of inner tube 26 from fuel supply line 27 is forced to flow out of fuel-injection holes 78 to mix with high-velocity, swirling air 20 passing through annular high-velocity passageway 73 surrounding inner tube 26 and communicating with fuel-injection holes 78.

Burner 10 swirls air 20 in a relatively low-velocity (large inner diameter) passageway 54 downstream of swirler 28 to minimize pressure drop across swirler 28. Burner 10 accelerates air 20 through nozzle-shaped passageway 65 from low-velocity passageway 54 toward a fuel-injection point (e.g., 78) to minimize the chance of fuel 33 flowing in upstream direction 45 after it mixes with air 20 in high-velocity passageway 73. Fuel 33 is injected into air 20 moving through passageway 73 in burner 10 to avoid the need for creating an air-and-fuel premixture outside of burner 10. Fuel 33 is injected into fast-moving air 20 that had been accelerated in nozzle-shaped passageway 65 to minimize chance of burning occurring inside burner 10. Fuel 33 is injected perpendicularly to air stream 20 in a manner that provides sufficient mixing to achieve low $NO_x$ emissions, given the proper air and fuel ratio. Burner 10 stabilizes flame 18 (i.e., prevent flame 18 from blowing out) in the swirling wake of bluff-body flame holder 32, which is positioned to lie a short distance 49 (preferably less than one throat-pipe diameter, i.e., radial gap 72) inside the flame chamber 19 formed in refractory block 16.

Burner 10 is used, for example, in the field of fume incineration. For example, when cars or trucks are processed through paint systems during the manufacturing process, burner 10 can be used to burn off the paint fumes instead of emitting the fumes into the atmosphere. Similarly, burner 10 can be used to burn petroleum fuel vapors that are created when petroleum fuel is transferred from one process to another. Additionally, burner 10 can be used to burn fumes that are created by semiconductor chip manufacturers during a chip manufacturing process.

Burner 10 can also be used for other applications in which a burner is necessary. For example, burner 10 could be used to incinerate liquid or solid waste products from almost any manufacturing process. In addition, burner 10 could be used to burn off waste products that are created during the manufacturing process of drywall material during a calcining process. Burner 10 could also be used in the furnace industry or aggregate dryer industry.

The burner 10 of the present invention can be configured to achieve low $NO_x$ emissions in both high $O_2$ environments and low $O_2$ environments. As mentioned above, a high $O_2$ environment is one in which $O_2$ in the process chamber (or furnace chamber) is greater than 12% (typically 17–19%). In this environment, the burner 10 can only achieve low $NO_x$ emissions by operating in excess air mode. Further, a swirler is needed to operate in excess air mode. Accordingly, although burner 10 can run with or without a swirler 28, the swirler 28 must be included in the burner 10 to achieve low $NO_x$ emissions in the high $O_2$ environment. Although swirler 28 is not needed for burner 10 to operate, swirler 28 creates a "slow" area in the middle of the flame that resembles an "eye of the storm" and this helps stabilize flame 18 generated by burner 10. To achieve low $NO_x$ emissions, in a low $O_2$ environment (i.e., wherein the $O_2$ in the process chamber is less than or equal to 12%—typically less than 6%), a short refractory block 116 is used in conjunction with burner 10 to achieve low $NO_x$ emissions and a swirler is not needed. This embodiment is described in more detail below with reference to FIGS. 14–16.

Burner 10 incorporates mixing techniques that provide for a desirably short burner length. The gas 33 is injected perpendicular to the air 20 with a momentum flux that optimizes mixing within an annulus 73. Then the gas 33 and air 20 exit the annulus 73 and pass over the flame holder 32 prior to burning. Because the flame holder 32 stands off the annulus 73, the gas 33 and air 20 have further time to mix after exiting the annulus 73. The post-exit area is larger than the annulus 73, which means that the flow 35 decelerates as it exits. Shear forces created by this deceleration as well as the changes in velocity directly attributable to the flame holder 32 itself mix the gas 33 and air 20 prior to combustion. Enhanced mixing reduces emissions from burner 10. Standing the flame holder 32 off from the annulus 73 requires careful attention to velocities to prevent burning behind the flame holder 32 but allows for very quick mixing.

Figure 6:
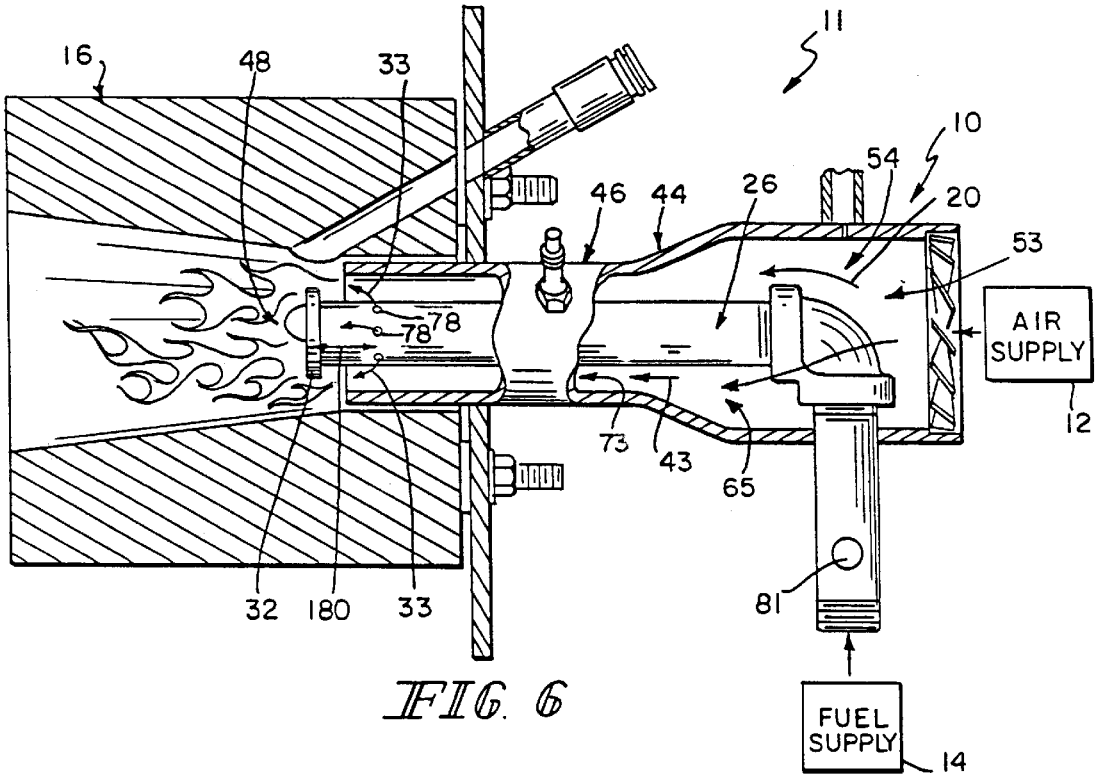
FIG. 6 is a side elevation view of a burner similar to the burner of FIG. 1, showing placement of fuel-injection holes in an inner tube at a location lying downstream from the location shown in FIG. 1 and closer to the bluff-body flame holder to discharge fuel into a region immediately upstream of the bluff-body flame holder.
Figure 6A:
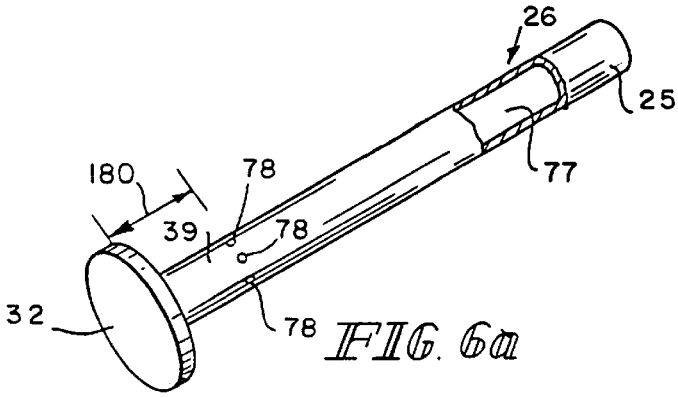
FIG. 6A is a perspective view of the inner tube of FIG. 6 showing the bluff-body flame holder coupled to the downstream end of the inner tube and fuel-injection holes formed in a portion of the inner tube located immediately upstream from the bluff-body flame holder.
Figure 7:
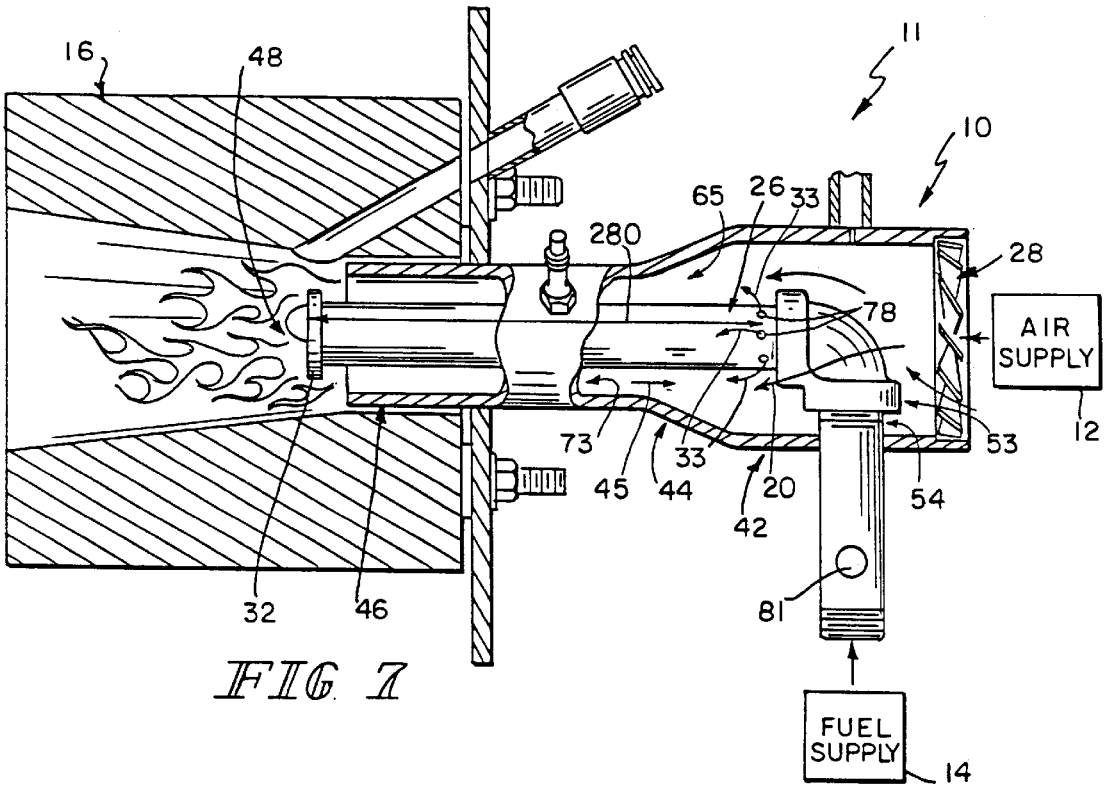
FIG. 7 is a side elevation view of a burner similar to the burner of FIG. 6, showing placement of fuel-injection holes in an inner tube at a location lying upstream from the location shown in FIG. 6 and closer to the swirl plate to discharge fuel into a region immediately downstream of the swirler.
Figure 7A:
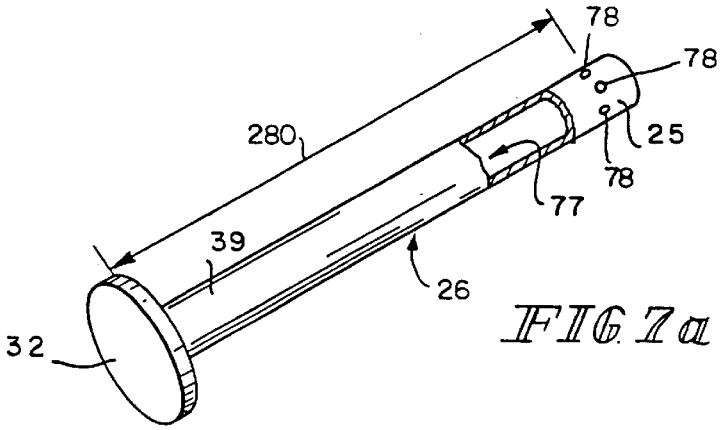
FIG. 7A is a perspective view of the inner tube of FIG. 7 showing the bluff-body flame holder coupled to the downstream end of the inner tube and fuel-injection holes formed in a portion of the inner tube located at the upstream end of the inner tube.

Fuel-injection holes 78 can be formed at any point in inner tube 26 as shown, for example, in the embodiments of FIGS. 6 and 7, to enable discharge of fuel 33 conducted through passageway 77 in inner tube 26 into high-velocity passageway 73 formed in mixing/igniting section 46. While fuel-injection holes 78 are formed in inner tube 26 at a point near inlet end 74 of high-velocity passageway 73 in the embodiment of FIG. 1, fuel-injection holes 78 are moved in a downstream direction 43 in the embodiment of FIG. 6 so as to be formed in inner tube 26 at a point near exit end 76 of high-velocity passageway 73. However, in the embodiment of FIG. 7, the fuel-injection holes 78 are moved in an upstream direction 45 and are formed in a section of inner tube 26 positioned to lie in air-admitting section 42 (low-velocity passageway 54) near the swirler 28. Fuel-injection holes 78 could also be formed in a section of an inner tube 26 positioned to lie in air-accelerating section 44 (nozzle-shaped passageway 65).

Figure 11:
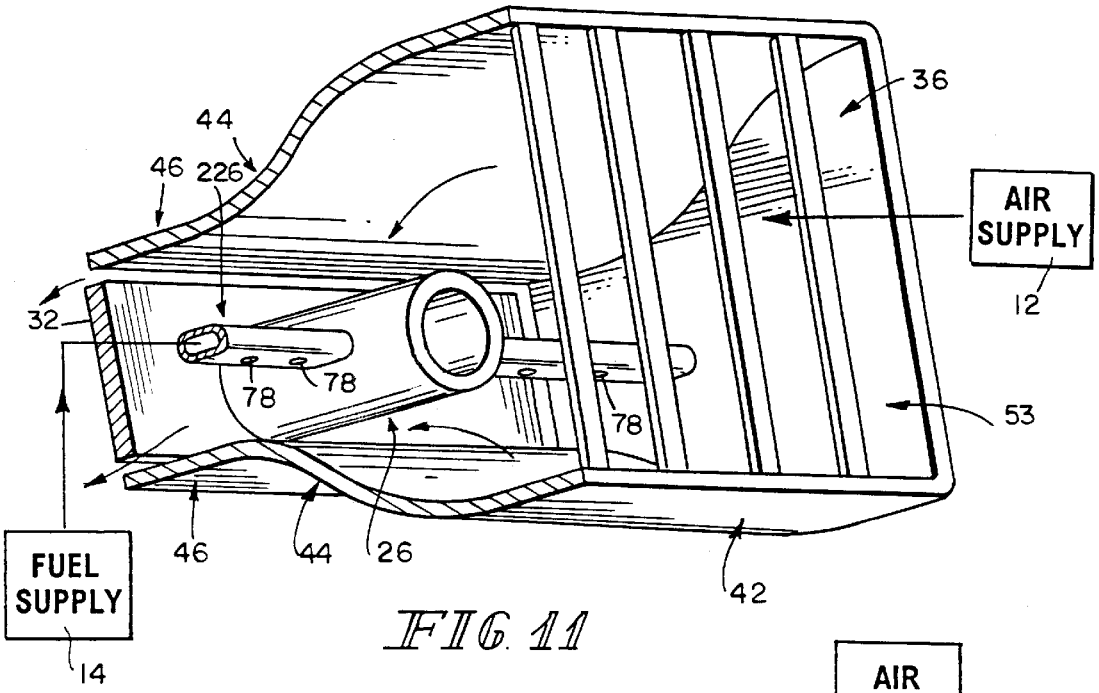
FIG. 11 is a perspective view of a burner in accordance with a further embodiment of the present invention showing an air-receiving passageway having a somewhat rectangle-shaped cross-section.
Figure 11A:
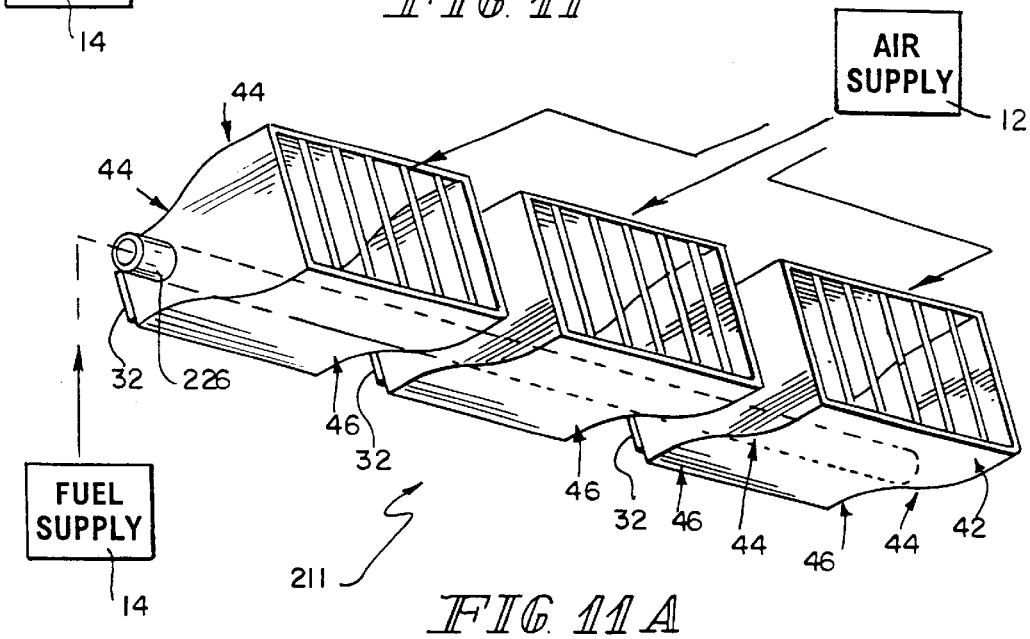
FIG. 11A is a perspective view of a line burner in accordance with an additional embodiment of the invention showing three burners of the type shown in FIG. 11 arranged in sequence to define a line burner assembly.

In the embodiments shown in FIGS. 1–7, outer tube 24 of burner 10 is formed to include a single "axi-symmetric" flow passage 53 defined by passageways 54, 65, 73 that admits air 20 in a large-diameter passageway 54 which minimizes the pressure drop across swirler 28 or other obstructions at that location. Because the outer tube 24 is preferably cylindrical, the differences in diameter between inlet portion 42, outlet portion 46, and nozzle portion 44 determine how the air 20 or mixture 35 is accelerated. However, as shown in FIG. 11, when the shape of the outer tube 24 is something other than cylindrical, the differences in effective cross-sectional areas of the inlet portion 42, outlet 35 portion 46, and nozzle portion 44 determine the acceleration. Thus, the differences in effective cross-sectional area between these portions 42, 44, 46 determine the acceleration of air 20 or mixture 35 for cylindrical cross sections as well as other cross sections.

In the embodiments of FIGS. 1–6, air 20 then accelerates toward ignitor 30 through conical portion 44. This eliminates the chance of having an upstream flow of fuel and improves air flow distribution if the inlet air flow is unbalanced. Fuel 33 is then injected into air 20 at any point within the high-velocity passageway 73 (FIGS. 1–6), to minimize the potential for unwanted early ignition that could result if a premixture was created in a pipe train leading to the burner. However, as fuel-injection holes 78 are moved in an upstream direction 43 from the position shown in FIGS. 1–5 to the position shown in FIG. 6, the mixing length distance (from the fuel-injection holes 78 to the flame holder 32) is reduced from a distance 80 in FIGS. 1–5 to a distance 180 in FIG. 6. Although the shorter distance 180 in FIG. 6 minimizes the chance of burning within burner 10, the larger distance 80 in FIGS. 1–5 is preferable because more "complete" mixing can be accomplished. The fuel 33 is injected into the air 20 perpendicularly to cause fuel 33 to mix with air 20 in a "complete" manner. Finally, a bluff-body flame holder 32 stabilizes flame 19 within the combustion chamber 19.

As shown in FIG. 7, by locating the fuel-injection holes 78 immediately downstream of the swirler 28 in the low-velocity passageway 54 formed in air-admitting section 44, fuel 33 can be injected into a region within burner 10 containing a highly turbulent, low-velocity air flow (as compared to the air flow in the high-velocity passageway 73 shown in the embodiments of FIGS. 1–5 and 6). The mixing length distance 280 between fuel-injection holes 78 and flame holder 32 in the embodiment of FIG. 7 is longer than the mixing length distances 80, 180 shown in the embodiments of FIGS. 1–5 and 6, respectively, to facilitate mixing of air and fuel in the burner. Although injection of fuel 33 downstream from swirler 28 reduces the mixing that would be gained by having the mixture pass through swirler 28, this downstream fuel injection within passageway 73, 54, or 65 ensures that the swirler 28 will not get burned up, especially at lower flow rates.

Figure 8:
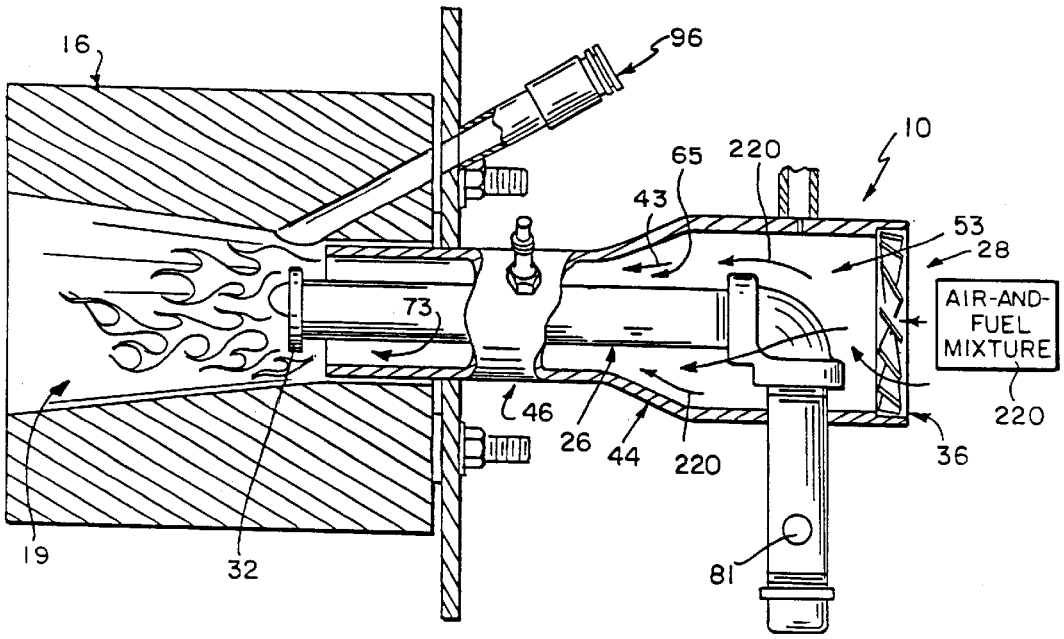
FIG. 8 is a side elevation view of a burner similar to the burners of FIGS. 1–7 in accordance with another embodiment of the present invention showing admission of a premixed air-and-fuel mixture into the inlet end of the burner with no fuel supply coupled to the inner tube.

In the embodiment of FIG. 8, there are no fuel-injection holes 78 formed in inner tube 26 and there is no fuel supply coupled to the inner tube 26. Instead, the inner tube 26 simply acts as a support for the flame holder 32. As shown in FIG. 8, a premixed air-and-fuel mixture 220 is admitted into the inlet end 36 of the burner 10. The air-and-fuel mixture 220 passes through swirler 28 as it enters air-admitting section 42. The air-and-fuel mixture 220 is then accelerated through conical portion 44 before entering cylindrical portion 46. The air-and-fuel mixture 220 is then ignited within the cylindrical portion 46 and is forced in the downstream direction 43 to produce a flame (not shown) that attaches to flame holder 32.

Figure 9:
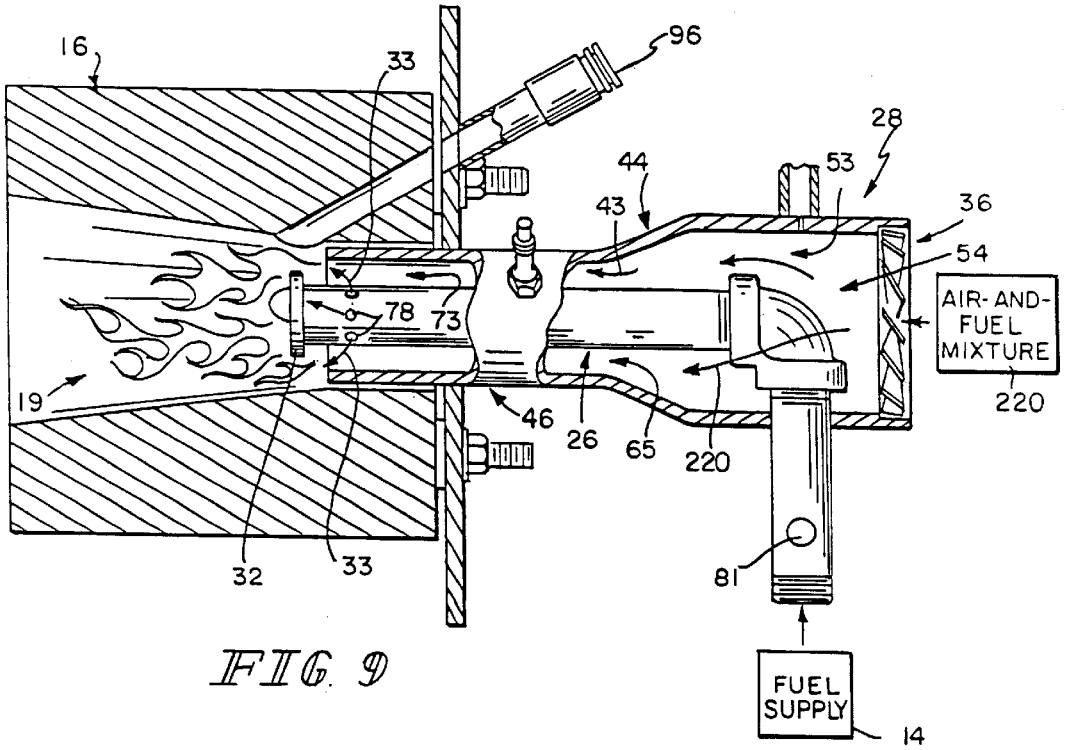
FIG. 9 is a side elevation view of a burner similar to the burner of FIG. 8 in accordance with yet another embodiment of the present invention showing admission of a premixed air-and-fuel mixture into the inlet end of the burner in combination with a fuel supply coupled to the inner tube to allow fuel from the fuel supply to be discharged through fuel-injection holes formed in the inner tube and combined with the air-and-fuel mixture admitted through the inlet end of the burner.

In the embodiment of FIG. 9, the burner of FIG. 8 is modified so that inner tube 26 is formed to include injection holes 78 and is coupled to fuel supply 14. Although injection holes 78 are shown at a location near flame holder 32, the position of fuel injection holes 78 can be in any of the positions shown in FIGS. 1–7 or the description relating to FIGS. 1–7. Thus, in the embodiment of FIG. 9, the air-and-fuel mixture 220 can be supplemented by having fuel 33 injected through holes 78 within passageways 54, 65, or 73. Of course, the air-fuel ratio of the air-and-fuel mixture 220 coming in via the inlet end 36 need not be the same as that coming in via the fuel-injection holes 78.

Figure 10:
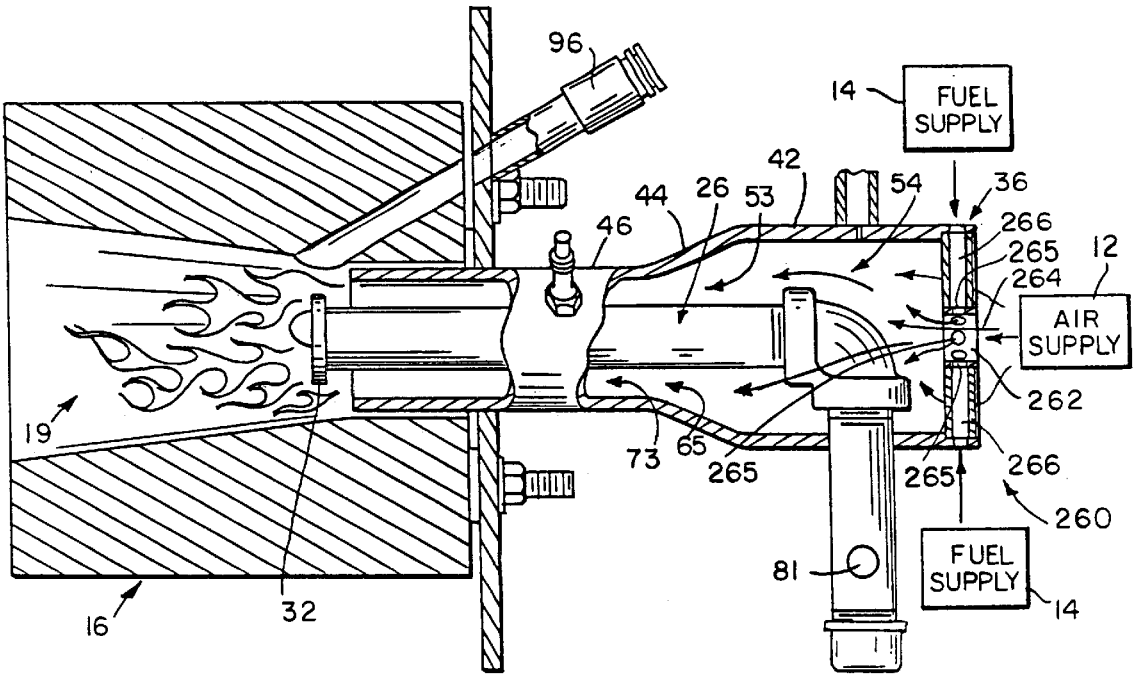
FIG. 10 is a side elevation view of a burner similar to the burners of FIGS. 1–9 in accordance with still another embodiment of the present invention showing injection of fuel through a fuel supply manifold mounted at the inlet end of the burner.
Figure 10A:
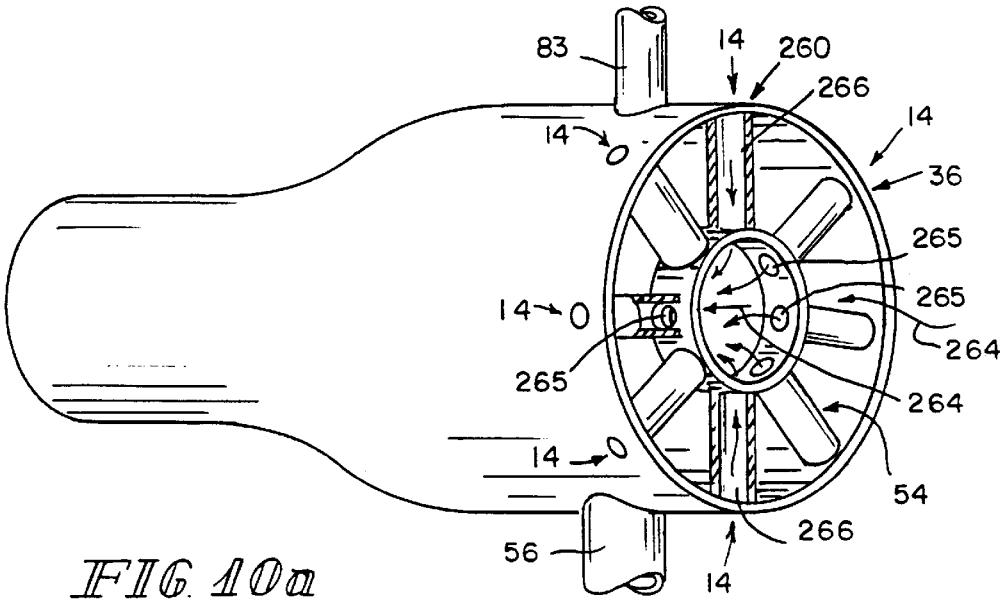
FIG. 10A is a perspective view of the burner of FIG. 10 showing passage of fuel into the outer tube of the burner through circumferentially spaced-apart tubular spokes included in the wagon wheel-shaped fuel supply manifold.

In the embodiment of FIG. 10, a fuel-injection manifold 260 is used to inject fuel 33 from fuel supply 14 into the burner 10 at the air inlet end 36. As shown in FIG. 10A, manifold 260 includes a ring 262 defining an air-flow passageway 264 and a plurality of spoke-like injector tubes 266 for discharging fuel 33 through apertures 265 formed in ring 262 into the low-velocity air 20 passing through the air-flow passageway 264. The injector tubes 266 may or may not be configured to induce swirl of air 20 passing from air supply 12 through spaces between the injector tubes 266 and outside of ring 262. The fuel-injection manifold 260 in accordance with this embodiment is configured to inject fuel 33 through tubes or other suitable injectors at the air inlet of the burner, thereby maximizing the mixing time of air and fuel within the burner body. A fuel-injection manifold in accordance with this embodiment is well-suited for use with liquid fuels. In addition, although not shown in FIG. 10, a secondary fuel supply could be coupled to the inner tube 26 with the inner tube 26 being formed to include fuel-injection holes 78 as shown in FIGS. 1–7.

In the embodiment of FIG. 11, the burner 10 may incorporate any of the fuel-injection methods described above for FIGS. 1–10. However, in the embodiment of FIG. 11, the passageways 54, 65, 73 are rectilinear rather than axisymmetric as shown in FIGS. 1–10. As shown in FIG. 11, a supplemental fuel-injection tube 226 is preferably used to inject fuel 33 into air 20. The supplemental tube 226 is coupled to fuel supply 14 and arranged to extend perpendicularly through inner tube 26 as shown in FIG. 11 so that fuel 33 will be distributed evenly throughout the rectilinear sections 42, 44, 46. In this embodiment, the fuel-injection holes 78 are formed on the supplemental tube 226 instead of the inner tube 26. This embodiment could also be extended to cover a tee, a cross, an H, an I, or other suitable shape. Inner tube 26 is also used to support flame holder 32. Two or more rectilinear burners can be arranged in line as shown in FIG. 11 A to create a line burner assembly 211 supplied with fuel via supplemental tube 226 coupled to fuel supply 14.

Figure 12:
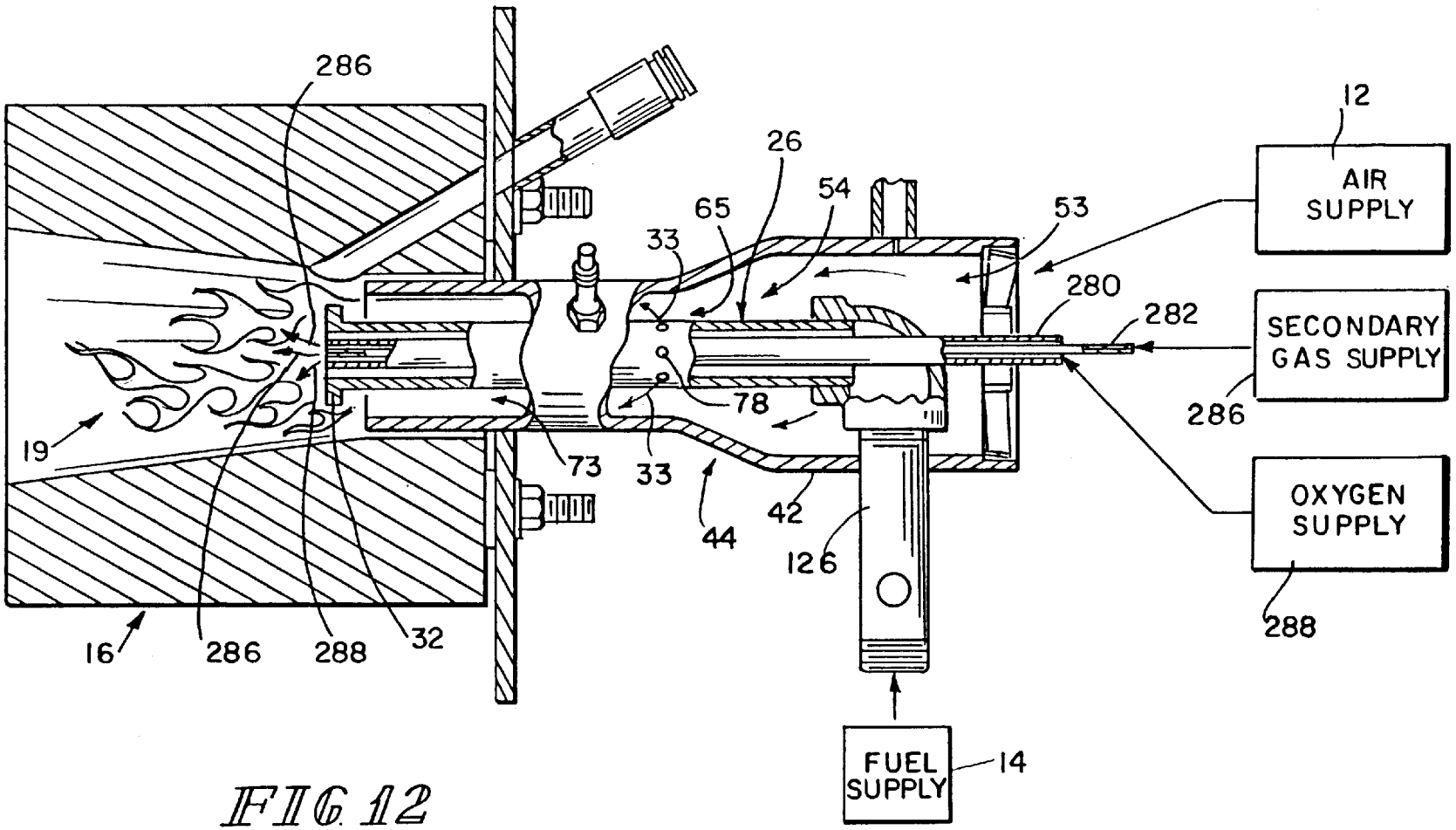
FIG. 12 is a perspective view of a burner similar to the burner in FIGS. 1–5, with portions broken away, showing an inner fuel supply tube configured to discharge fuel from a primary fuel supply through fuel injection holes formed in the inner tube and a pair of concentric tubes extending through the inlet end of the burner and into the inner tube and terminating at the flame holder, an outer tube of the concentric tubes being configured to discharge oxygen from an oxygen supply at an outlet end of the burner and an inner tube of the concentric tubes being configured to discharge fuel from a secondary fuel supply at a flame outlet end of the burner.

In the embodiment of FIG. 12, a pair of concentric tubes 280, 282 are used to discharge secondary fuel 286 and oxygen 288 at the flame holder 32. Preferably the oxygen 288 is 75% purity or higher, but oxygen purities of less than 75% can also be used. The secondary fuel 286 and oxygen 288 travel through tubes 280 and 282 respectively so that the secondary fuel 286 and oxygen 288 can burn at the face of the bluff- body flame holder 32 with or without the assistance of fuel 33 being admitted through fuel-injection holes 78, which can be located on any of the positions shown in FIGS. 1–7. A primary fuel supply tube 126 is configured to discharge fuel 33 from primary fuel supply 14 at the flame outlet end of the burner. The concentric tubes 280, 282 extend through the inlet end of the burner and a portion of the primary fuel supply tube 126 and terminate at flame holder 32.

Figure 13:
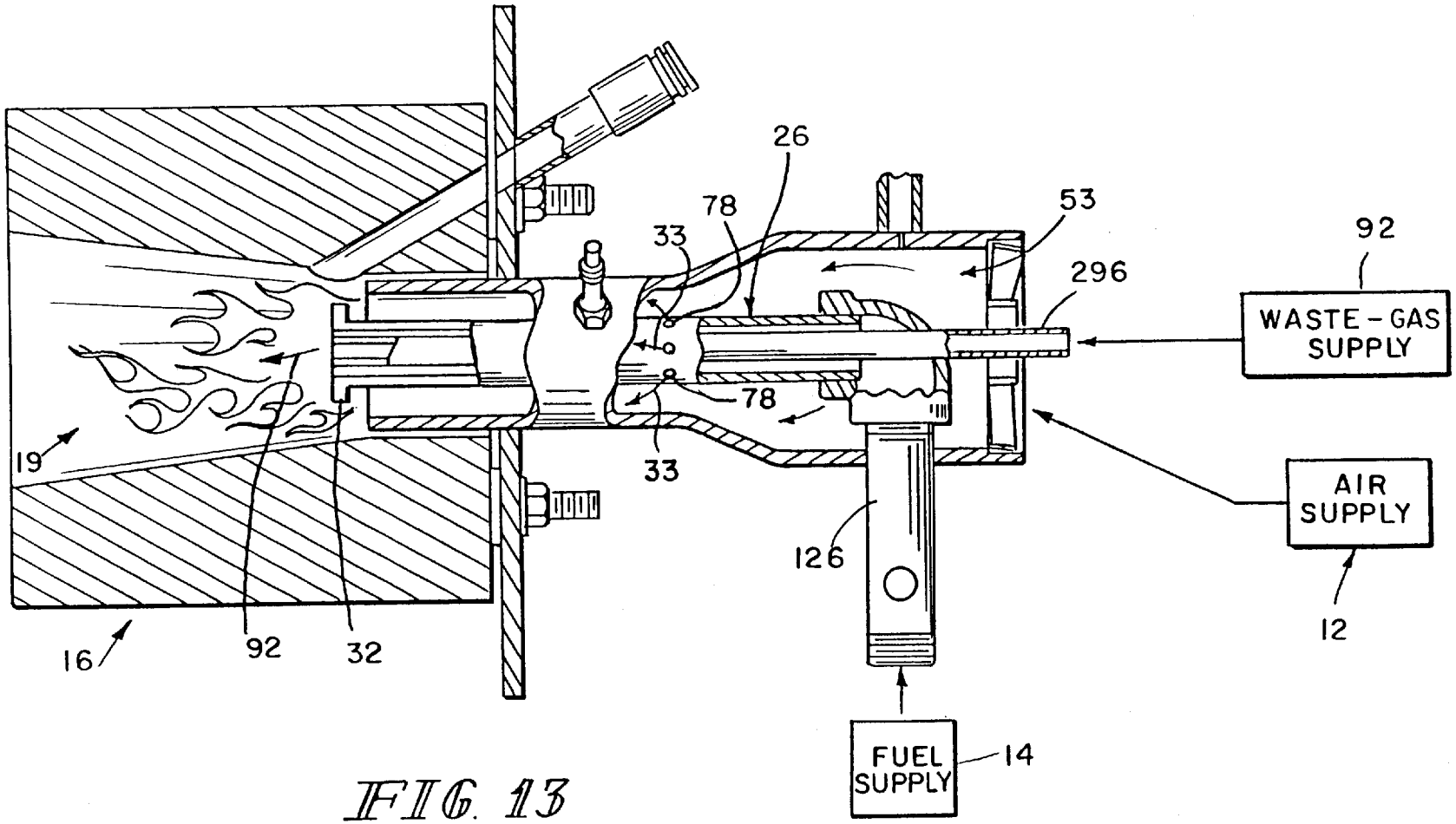
FIG. 13 is a perspective view of a burner similar to the burner in FIGS. 1–5, with portions broken away, showing an inner fuel supply tube configured to discharge fuel from a primary fuel supply through fuel injection holes formed in the inner tube and a single tube extending through the inlet end of the burner an into the inner tube and terminating at the bluff-body flame holder for discharging waste gas from a waste-gas supply at a flame outlet end of the burner.

In the embodiment of FIG. 13, difficult-to-burn gas 92 such as a secondary gas or a waste gas is introduced through a single tube (or lance) 296. The embodiment of FIG. 13 is identical to the embodiment of FIG. 12 except that only a single tube 296 is used. A primary fuel supply tube 126 is configured to discharge fuel 33 from primary fuel supply 14 at the flame outlet end of the burner. The waste-gas tube 296 extends through the inlet end of the burner and a portion of the primary fuel supply tube 126 and terminate at flame holder 32.

Figure 14:
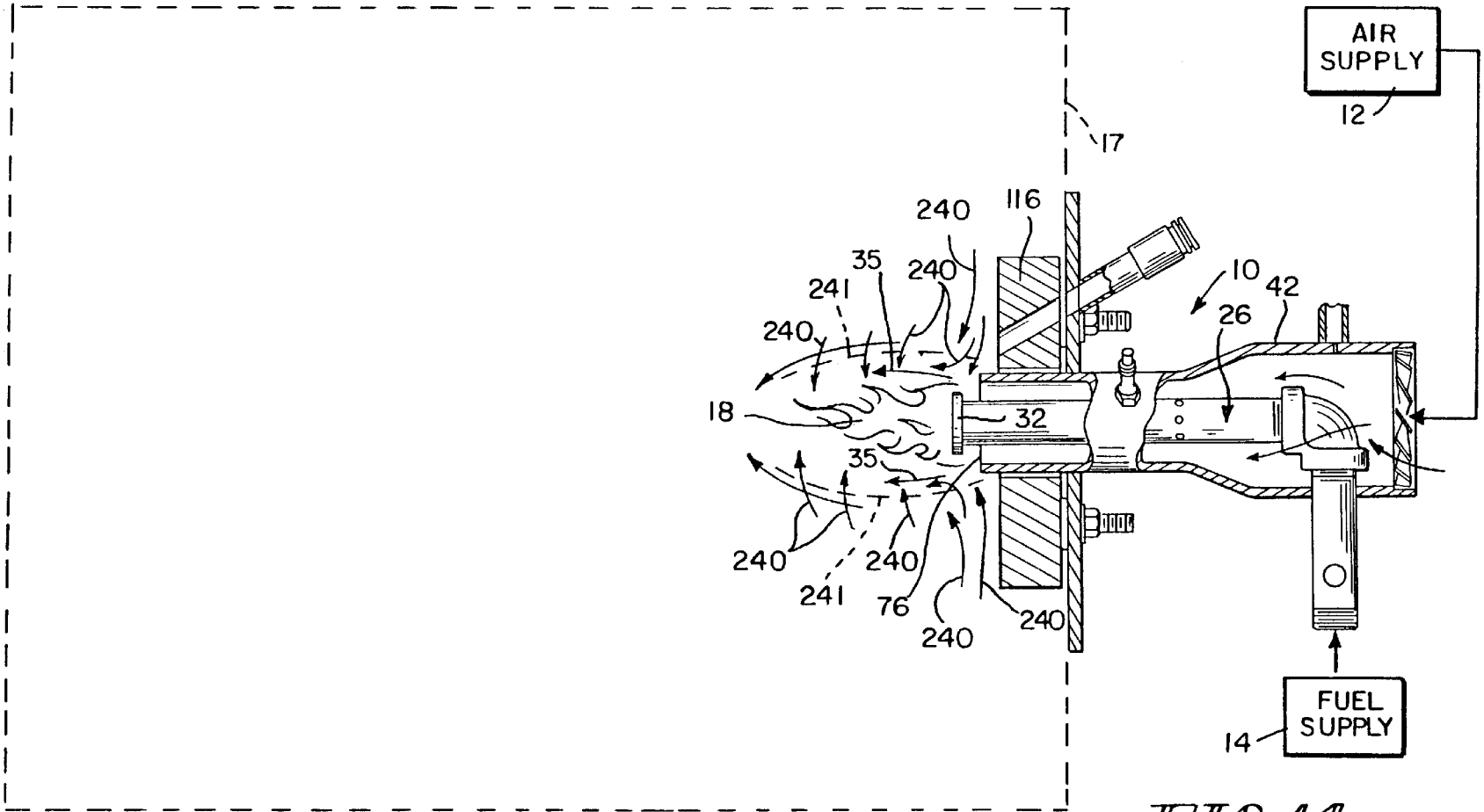
FIG. 14 is a side elevation view of a burner assembly similar to the burner assembly of FIGS. 1–5, showing the burner of FIGS. 1–5 being coupled to a furnace chamber using a short refractory block so that an air-and-fuel mixture discharged from an exit end of the burner mixes with recirculated furnace gases (products of combustion) contained in the furnace chamber.
Figure 15:
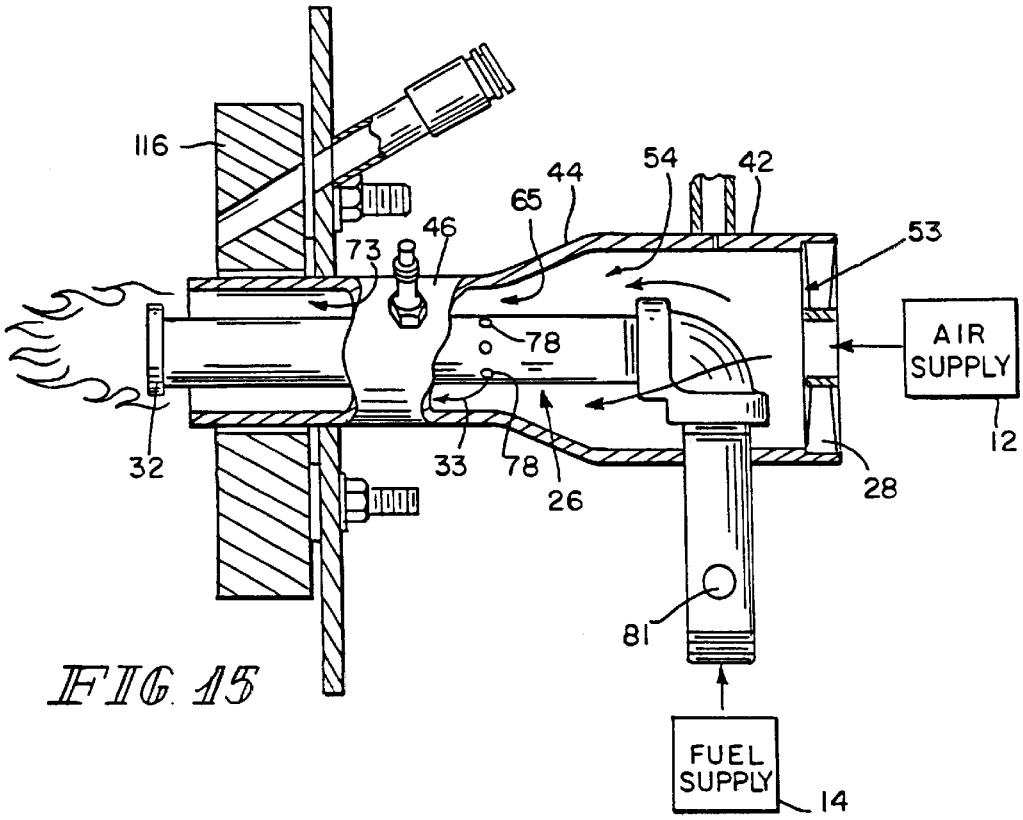
FIG. 15 is an exploded side elevation view of the burner assembly of FIG. 14, showing burner of FIG. 14 in more detail.
Figure 16:
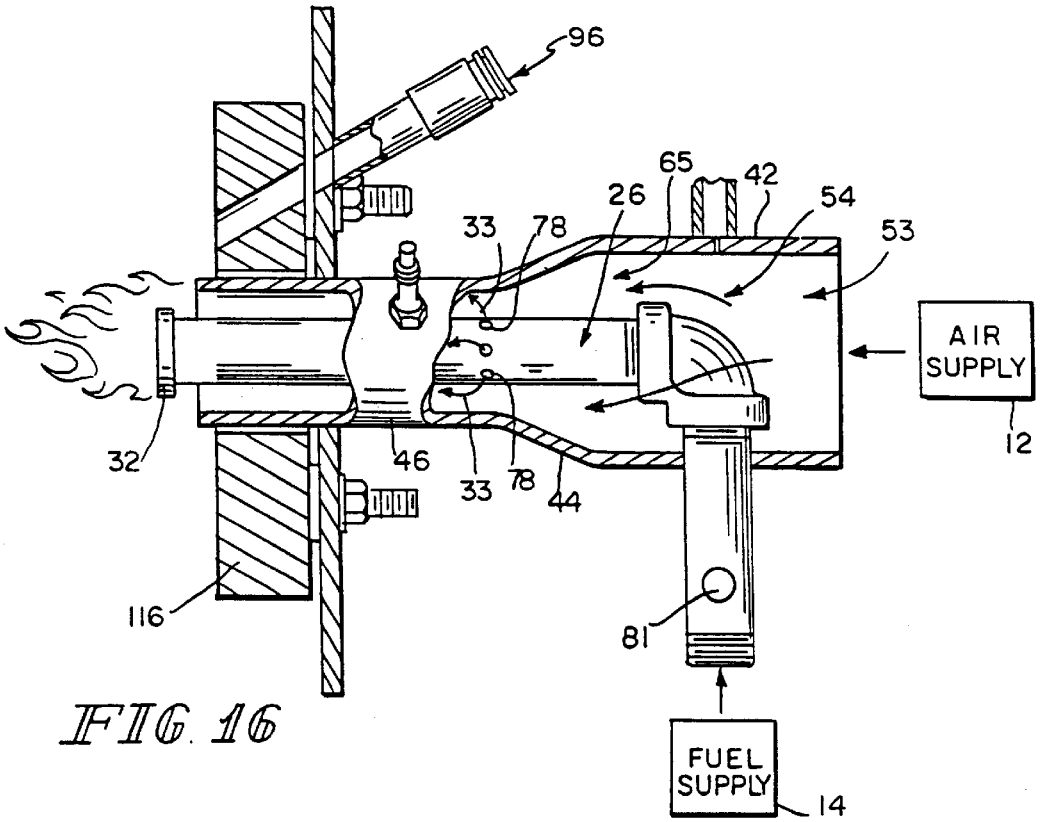
FIG. 16 is a side elevation view of a burner assembly similar to the burner assembly in FIG. 15, showing the burner without a swirler.

In the embodiments of FIGS. 14–16, a short refractory block 116 is used. Any of the burners shown in FIGS. 1–13 can be combined with the short refractory block 116 shown in FIGS. 14–16. As shown in FIG. 14, burner 10 can be connected to a furnace chamber 17 using the short refractory block 116. With a short refractory block 116, the air-and-fuel premixture 35 enters the furnace chamber 17 immediately upon exiting the exit end 76 of the cylindrical portion 46. The premixture 35 then mixes with furnace gases 240 as the mixture 35 passes around flame holder 32. Furnace gases 240 are those gases that exist in a furnace, or other process chamber, that are the by-products of fuel combustion—these gases contain nitrogen, water vapor, carbon dioxide and the excess oxygen left over from the combustion of the fuel. The momentum and viscosity of the premixture 35 induces a circulating flow of furnace gases 240 within the combustion chamber 17. The furnace gases 240 are entrained into the premixture 35 so that the presence of the furnace gas 240 into the premixture 35 dilutes the $O_2$ within the premixture 35 and adds to its thermal capacitance. This reduces the adiabatic flame temperature which ultimately reduces the thermal $NO_x$ formation rate. The furnace gas 240 continues to migrate towards the premixture 35 across a diffusion boundary 241 between furnace gas 240 and premixture 35 so that furnace gas 240 is continually recirculated towards the flame 18. Because the short refractory block 116 allows furnace gas 240 to be recirculated and burned within the furnace chamber 17, additional piping for external furnace gas recirculation is not needed. In addition, fuel staging is not needed with the burner of the present invention in either the low $O_2$ or the high $O_2$ environment. Also, in the low $O_2$ environment anti-flashback mechanisms are not needed because fuel comes in at only one place such that secondary fuel supplied downstream for typical low $O_2$ environments is not needed.

The burner of FIG. 14 is shown in more detail in FIG. 15. As shown in FIG. 15, the burner can be any of the burners shown in FIGS. 1–13 with the exception that a short refractory block 116 is used. Similarly, FIG. 16 shows that any of the burners of FIGS. 1–15 can be configured without a swirler. All embodiments thus far have shown a swirler or some other obstruction in the air inlet. Such an obstruction improves flame stability when the burner is run with excess air, however, the swirler or forms of obstruction are not required. Under this scenario, the flame is stable near Stoichiometric air/fuel ratios which is more likely applicable for the low $O_2$ environment.

Although the invention has been described in detail with reference to certain preferred embodiments, variations and modifications exist within the scope and spirit of the invention as described and defined in the following claims.

What is claimed is:

1. A burner comprising an outer tube defining a flow passage and including a large-diameter inlet portion having a large diameter, a small-diameter outlet portion having a small diameter being smaller than the large diameter of the large-diameter inlet portion, and a nozzle portion interconnecting an outlet end of the inlet portion and an inlet end of the outlet portion and converging toward the outlet portion to establish the flow passage, an inlet end of the large-diameter inlet portion being adapted to be coupled to an air supply to conduct air flowing through the flow passage to an outlet end of the outer tube and a small-diameter inner tube being positioned to lie in the flow passage of the outer tube, the inner tube having an inlet end positioned to lie in the flow passage outside of the small-diameter outlet portion and adapted to be coupled to a fuel supply, the inner tube having a diameter that is smaller than the small diameter of the outer tube, and the inner tube being formed to include a downstream end opposite to the inlet end and a fuel-injection hole positioned to lie in spaced-apart relation to the downstream end to conduct fuel flowing from the inlet end of the inner tube through the inner tube into the air flowing through the flow passage to establish a combustible air-and-fuel mixture within the flow passage, and a flame holder coupled to the downstream end of the inner tube and positioned to extend beyond an exit end of the small-diameter outlet portion of the outer tube and lie outside the flow passage defined by the outer tube to complete the mixing of the fuel with the air as the combustible air-and-fuel mixture exits the flow passage of the outlet end of the outer tube to produce a low-emission flame attached to the flame holder upon ignition of the combustible air-and-fuel mixture.

2. The burner of claim 1, wherein the fuel-injection hole is formed in the inner tube so that the hole is positioned to lie within the small-diameter outlet portion of the outer tube.

3. The burner of claim 2, further comprising an ignitor coupled to the outer tube, positioned to lie between the fuel-injections hole and the flame holder, and configured to ignite the combustible air-and-fuel mixture.

4. The burner of claim 2, wherein a swirler is coupled to the outer tube within the large-diameter inlet portion to swirl the air through the flow passage.

5. The burner of claim 1, wherein the fuel injection hole is formed in the inner tube so that the hole is positioned to lie within the nozzle portion of the outer tube.

6. The burner of claim 5, further comprising an ignitor coupled to the outer tube, positioned to lie between the fuel-injection hole and the flame holder, and configured to ignite the combustible air-and-fuel mixture.

7. The burner of claim 5, wherein a swirler is coupled to the outer tube within the large-diameter inlet portion to swirl the air through the flow passage.

8. The burner of claim 1, wherein the fuel injection hole is formed in the inner tube so that the hole is positioned to lie within the large-diameter inlet portion of the outer tube.

9. The burner of claim 8, further comprising an ignitor coupled to the outer tube, positioned to lie between the fuel-injection hole and the flame holder, and configured to ignite the combustible air-and-fuel mixture.

10. The burner of claim 8, wherein a swirler is coupled to the outer tube within the large-diameter inlet portion to swirl the air through the flow passage.

11. The burner of claim 1, wherein the inlet end of the large-diameter inlet portion is adapted to be coupled to a fuel supply to conduct an air-and-fuel mixture through the flow passage.

12. The burner of claim 1, wherein a fuel-injection manifold is adapted to be coupled to the inlet end of the large-diameter inlet portion of the outer tube, the manifold including a ring defining an air-flow passageway and at least one spoke-like injector tube for discharging fuel through apertures formed in the ring into the air passing through the air-flow passageway.

13. A burner comprising an outer tube defining a flow passage and including a large-diameter inlet portion having a large diameter, a small-diameter outlet portion having a small diameter being smaller than the large diameter of the large-diameter inlet portion, and a nozzle portion interconnecting an outlet end Of tile inlet portion and an inlet end of tile outlet portion to establish the flow passage, an inlet end of the large-diameter inlet portion being adapted to be coupled to an air supply to conduct air flowing through the flow passage to an outlet end of the outer tube, a swirler is coupled to the outer tube within the large-diameter inlet to swirl air through the flow passage, means for discharging fuel into the air passing through the flow passage to form a combustible air-and-fuel mixture therein for discharge into a flame chamber at the outlet end of the small-diameter outlet portion wherein the means for discharging fuel includes an inner tube having a diameter smaller than the diameter of the small diameter outlet portion of the outer tube, and a flame holder coupled to a downstream end of the inner tube and positioned to lie outside the flow passage of the outer tube.

14. The burner of claim 13, wherein the inner tube has a fuel-injection hole formed therein for discharging the fuel.

15. The burner of claim 14, wherein the fuel-injection hole is positioned to lie within the small-diameter portion of the outer tube.

16. The burner of claim 13, wherein the means for discharging fuel discharges fuel into the small-diameter outlet portion of the outer tube.

17. The burner of claim 16, wherein a swirler is coupled to the outer tube within the large-diameter inlet portion to swirl the air through the flow passage.

18. The burner of claim 13, wherein the means for discharging fuel discharges fuel into the nozzle portion of the outer tube.

19. The burner of claim 13, wherein a swirler is coupled to the outer tube within the large-diameter inlet portion to swirl the air through the flow passage.

20. The burner of claim 13, wherein the means for discharging fuel discharges fuel into the large-diameter outlet portion of the outer tube.

21. The burner of claim 13, wherein the inlet end of the large-diameter inlet portion is adapted to be coupled to a fuel supply to conduct an air-and-fuel mixture through the flow passage.

22. The burner of claim 13, wherein a fuel-injection manifold is adapted to the coupled to the inlet end of the large-diameter inlet portion of the outer tube, the manifold including a ring defining an air-flow passageway and at least one spoke-like injector tube for discharging fuel through apertures formed in the ring into the air passing through the air-flow passageway.

23. A burner comprising means for moving an air flow in sequence through a first section at a low velocity, a second section at an accelerating velocity that is higher than the low velocity, and a third section at a high velocity that is higher than the accelerating velocity and means for discharging fuel carried in a tube through an aperture formed in a side wall of the tube into the air flow to form a combustible air-and-fuel mixture therein for discharge into a flame chamber at an outlet end of the means for moving an air flow.

24. The burner of claim 23, wherein the means for discharging fuel discharges fuel into the third section.

25. The burner of claim 23, further including a swirler coupled to the first section to swirl the air flowing through the first, second, and third sections.

26. The burner of claim 23, wherein the means for discharging fuel discharges fuel into the second section.

27. The burner of claim 26, further including a swirler coupled to the first section to swirl the air flowing through the first, second, and third sections.

28. The burner of claim 23, wherein the means for discharging fuel discharges fuel into the first section.

29. The burner of claim 28, further including a swirler coupled to the first section to swirl the air flowing through the first, second, and third sections.

30. A burner comprising an outer tube defining a flow passage and including an inlet portion having a large diameter, an outlet portion having a small diameter being smaller than the large diameter of the inlet portion, and a nozzle portion interconnecting an outlet end of the inlet portion and an inlet end of the outlet portion to establish the flow passage, an inlet end of the large-diameter inlet portion being adapted to be coupled to an air-and-fuel mixture supply to conduct an air-and-fuel mixture flowing through the flow passage to an outlet end of the outer tube, and a swirler positioned within the inlet portion of the outer tube.

31. The burner of claim 30, further comprising a small-diameter inner tube being positioned to lie in the flow passage of the outer tube and having a diameter that is smaller than the small diameter of the outer tube and a bluff-body flame holder being coupled to the inner tube and extending beyond an outlet end of the outlet portion of the outer tube.

32. The burner of claim 31, further comprising a swirler coupled to the outer tube to swirl the air flowing through the flow passage.

33. The burner of claim 32, wherein the swirler is positioned within the inlet portion of the outer tube.

34. The burner of claim 32, wherein the swirler is positioned within the nozzle portion of the outer tube.

35. The burner of claim 30, further comprising a swirler coupled to the outer tube to swirl the air flowing through the flow passage.

36. A burner comprising an outer tube defining a flow passage and including an inlet portion having a large diameter, an outlet portion having a smaller diameter than the large diameter of the inlet portion, and a nozzle portion interconnecting an outlet end of the inlet portion and an inlet end of the outlet portion and converging toward the outlet portion to establish the flow passage, an inlet end of the large-diameter inlet portion being adapted to be coupled to an air-and-fuel mixture supply to conduct an air-and-fuel mixture flowing through the flow passage to an outlet end of the outer tube, a small-diameter inner tube being positioned to lie in the flow passage of the outer tube, the inner tube having an inlet end adapted to be coupled to a fuel supply, the inner tube having a diameter that is smaller than the small diameter of the outer tube, and the inner tube being formed to include a plurality of fuel-injection holes positioned within the small-diameter outlet portion of the outer tube to conduct fuel flowing through the inner tube into the air-and-fuel mixture flowing through the flow passage, and a flame holder coupled to a flame outlet end of the inner tube, the flame holder being positioned adjacent to the outlet end of the outer tube.

37. A burner comprising an outer tube defining a flow passage and including a large-diameter inlet portion having a large diameter, a small-diameter outlet portion having a small diameter being smaller than the large diameter of the large-diameter inlet portion, and a nozzle portion interconnecting an outlet end of the inlet portion and an inlet end of the outlet portion to establish the flow passage, an inlet end of the large-diameter inlet portion being adapted to be coupled to an air-and-fuel mixture supply to conduct an air-and-fuel mixture flowing through the flow passage to an outlet end of the outer tube and a fuel-injection manifold coupled to the inlet end of the large-diameter inlet portion of the outer tube, the manifold including a ring defining an air-flow passageway and at least one spoke-like injector tube extending between the ring and the outer tube for discharging fuel through apertures formed in the ring into the air passing through the air-flow passageway.

38. A burner comprising an outer shell defining a rectilinear flow passage and including an inlet portion having a large volume, an outlet portion having a smaller volume than the large volume of the inlet portion, and a nozzle portion interconnecting an outlet end of the inlet portion and an inlet end of the outlet portion to establish the rectilinear flow passage, an inlet end of the large-volume inlet portion being adapted to be coupled to an air supply to conduct air flowing through the flow passage to an outlet end of the outer shell and a supplemental tube being positioned to extend perpendicularly through the flow passage of the outer shell, the supplemental tube having a first end adapted to be coupled to a fuel supply and the supplemental tube being formed to include a fuel-injection hole to conduct fuel flowing through the supplemental tube into the air flowing through the rectilinear flow passage.

39. A burner comprising a first tube defining a first flow passage and including an inlet portion having a large diameter an outlet portion having a smaller diameter than the large-diameter inlet portion, and a nozzle portion interconnecting the inlet portion and the outlet portion to establish the first flow passage an inlet end of the large-diameter inlet portion being adapted to be coupled to an air supply to conduct air through the first flow passage towards an outlet end of the first tube, a second tube defining a second flow passage and being positioned to lie in the first flow passage, the second tube having an inlet end adapted to be coupled to a fuel supply and being formed to include at least one fuel-injection hole to conduct fuel flowing through the second flow passage into the air flowing through the first flow passage, the second tube also having an outlet end adapted to be coupled to a flame holder to prevent fuel from exiting the outlet end of the second tube, the flame holder being positioned adjacent to the outlet end of the outer tube, a third tube defining a third flow passage and being positioned to lie in the second flow passage, an inlet end of the first tube being adapted to be coupled to an oxygen supply to conduct oxygen through the third flow passage towards the outlet end of the second tube, the third tube extending through the flame holder to conduct the oxygen out of the outlet end of the second tube, and a fourth tube defining a fourth flow passage and being positioned to lie in the third flow passage, an inlet end of the first tube being adapted to be coupled to a secondary fuel supply to conduct secondary fuel through the fourth passage towards the outlet end of the second tube, the fourth tube extending through the flame holder to conduct the secondary fuel out of the outlet end of the second tube.

40. A burner comprising a first tube defining a first flow passage and including an inlet portion having a large diameter, an outlet portion having a smaller diameter than the large-diameter inlet portion, and a nozzle portion interconnecting the inlet portion and the outlet portion to establish the first flow passage, an inlet end of the large-diameter inlet portion being adapted to be coupled to an air supply to conduct air through the first flow passage towards an outlet end of the first tube, a second tube defining a second flow passage and being positioned to lie in the first flow passage, the second tube having an inlet end adapted to be coupled to a fuel supply and begin, formed to include at least one fuel-injection hole to conduct fuel flowing through the second flow passage into the air flowing through the first flow passage, the second tube also having an outlet end adapted to be coupled to a flame holder to prevent fuel from exiting the outlet end of the second tube, the flame holder being positioned adjacent to the outlet end of the outer tube, and a third tube defining a third flow passage and being positioned to lie in the second flow passage, an inlet end of the first tube being adapted to be coupled to a waste-gas supply to conduct waste-gas through the third flow passage towards the outlet end of the second tube, the third tube extending through the flame holder to conduct the waste-gas out of the outlet end of the second tube.

41. A burner assembly comprising a burner having an outer tube including an inlet portion and an opposite outlet portion, the outer tube being adapted to be coupled to a furnace chamber such that the inlet portion of the outer tube is positioned to lie outside the furnace chamber and the outlet portion is positioned to lie inside the furnace chamber and a short refractory block being coupled to the outlet portion of the outer tube inside the furnace chamber and being shorter than the outlet portion such that the outlet portion extends beyond the refractory block further into the furnace chamber.

42. A burner comprising an outer tube defining a flow passage and including an inlet portion having a large effective cross-sectional area, an outlet portion having a small effective cross-sectional area being smaller than the effective cross-sectional area of the inlet portion, and a nozzle portion interconnecting an outlet end of the inlet portion and an inlet end of the outlet portion to establish the flow passage, an inlet end of the inlet portion being adapted to be coupled to an air supply to conduct air flowing through the flow passage to an outlet end of the outer tube, an inner tube being positioned to lie in the flow passage of the outer tube, the inner tube having an inlet end adapted to be coupled to a fuel supply and an opposite downstream end, the inner tube having an effective cross-sectional area that is smaller than the effective cross-sectional area of the outer tube, and the inner tube being formed to include a fuel-injection hole positioned to lie in spaced-apart relation to the downstream end to conduct fuel flowing through the inner tube into the air flowing through the flow passage to establish a combustible air-and-fuel mixture within the flow passage, and a flame holder coupled to the downstream end of the inner tube, the flame holder being positioned to lie outside the flow passage defined by the outer tube to complete the mixing of the fuel with the air as the combustible air-and-fuel mixture exits the outlet end of the outer tube to produce a low-emission flame attached to the flame holder upon ignition of the combustible air-and-fuel mixture.

* * * * *